United States Patent [19]

Rauch

[11] Patent Number: 4,472,853

[45] Date of Patent: Sep. 25, 1984

[54] TOOTHBRUSH

[76] Inventor: Samuel Rauch, 40 Spruce St., Cedarhurst, N.Y. 11516

[21] Appl. No.: 370,460

[22] Filed: Apr. 21, 1982

[51] Int. Cl.[3] ..... A46B 9/04

[52] U.S. Cl. ..... 15/167 R; 15/110; 15/201; 15/DIG. 5; 15/DIG. 6

[58] Field of Search ..... 15/201, 110, 167 R, 15/167 A, 172, 176, DIG. 5, DIG. 6

[56] References Cited

U.S. PATENT DOCUMENTS

| | | | |
|---|---|---|---|
| 1,133,930 | 3/1915 | Carroll | 15/167 A |
| 2,047,613 | 7/1936 | Brown | 15/172 X |
| 2,588,601 | 3/1952 | Zavangno | 15/167 A |
| 2,685,703 | 8/1954 | Dellenbach | 15/172 X |
| 3,722,020 | 3/1973 | Hills | 15/167 R |
| 4,010,509 | 3/1977 | Huish | 15/167 R |
| 4,209,871 | 7/1980 | Ernest et al. | 15/167 R |
| 4,288,883 | 9/1981 | Dolinsky | 15/110 |

FOREIGN PATENT DOCUMENTS

| | | | |
|---|---|---|---|
| 2142529 | 7/1971 | Fed. Rep. of Germany | 15/167 R |
| 452708 | 4/1913 | France | 15/201 |
| 1247433 | 10/1960 | France | 15/167 R |
| 169650 | 8/1934 | Switzerland | 15/167 R |

*Primary Examiner*—Peter Feldman

*Attorney, Agent, or Firm*—Kane, Dalsimer, Kane, Sullivan and Kurucz

[57] ABSTRACT

An improved toothbrush advantageously designed for horizontal brushing and selectively distributing brushing forces between the teeth and gums such that the teeth surfaces and gums are simultaneously cleaned and stimulated without damage to the gums.

18 Claims, 12 Drawing Figures

FIG.9
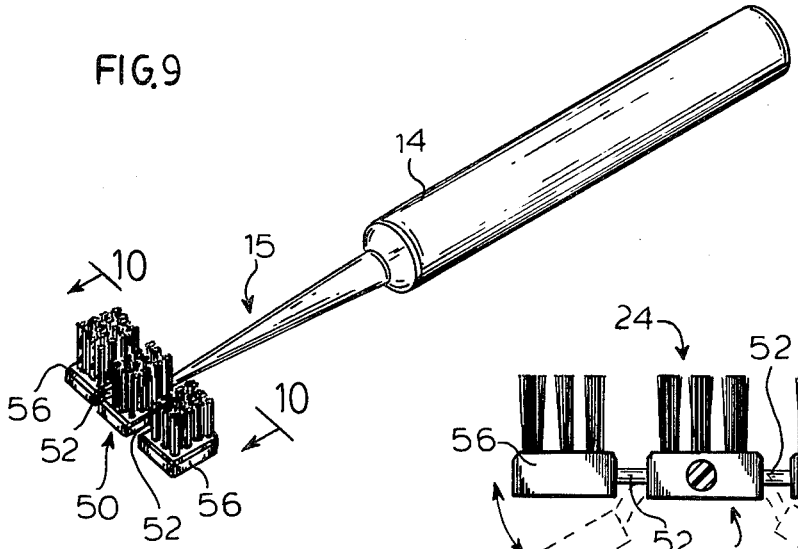
FIG.10
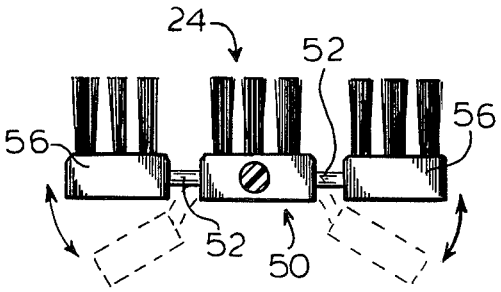
FIG.8
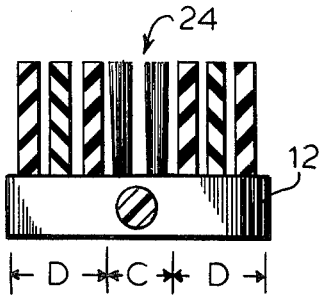
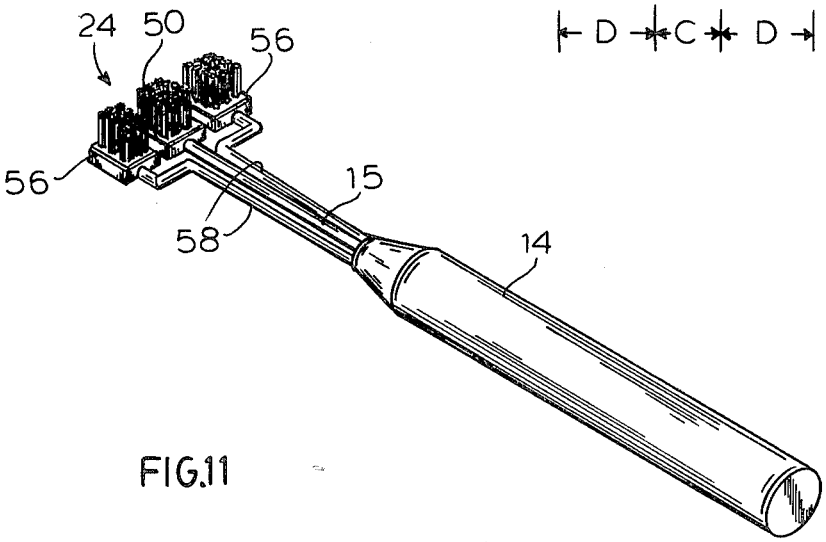
FIG.11

TOOTHBRUSH

The invention relates to a new and improved toothbrush. More specifically, a toothbrush having a brushing surface widened and shortened in length so when it is used it results in automatic and rapid cleaning of teeth and simultaneous cleaning and stimulating of gums and gumline.

A wide variety of toothbrush designs are well known in the art, e.g. U.S. Pat. No. 2,845,649 discloses the idea of soft bristles, and the importance of gum massage in oral health.

Until relatively recently, up and down brushing, i.e. vertical stroking, was the preferred and most widely recommended dental cleaning technique. When this method is used with a conventional toothbrush, the gums are inadvertently massaged (stimulated) as the brushing surface passes beyond the upper and lower gum lines. This gum stimulation promotes healthy gums and is an important part of dental hygiene. However, it has been found that vertical stroking pushes the gum away from teeth and forces food into the space between teeth and gums, contributing to peridontal disease and to cavities below the gum line. Such damage to the gums and teeth can be eliminated by brushing with a toothbrush having soft bristles with rounded ends and by using a motion that is primarily back and forth, i.e., a horizontal stroking technique. Consequently, horizontal stroking is now the preferred dental cleaning technique.

A shortcoming of horizontal stroking with a conventional toothbrush is that unless tedious and time-consuming procedures are used, proper cleaning and stimulation of the gums will not be accomplished. In other words, casual horizontal brushing with conventional toothbrushes does not result in properly stimulated gums and thus a very necessary part of good dental hygiene is lost. This is particularly harmful to the gums and teeth in the buccal corridor, that is, in the space between the cheek, gums, and teeth, because this area is not ordinarily stimulated by normal eating and chewing.

Another shortcoming of the conventional toothbrush is that the soft bristles suitable for gum contact are less effective for cleaning the hard tooth surfaces.

It is an object of the present invention to provide a toothbrush that, with casual horizontal brushing, effectively cleans teeth and simultaneously cleans and stimulates the gums.

Another object of the present invention is to provide a toothbrush that distributes the force applied to the handle so that a higher brush pressure is applied to the teeth to effectively clean them while simultaneously applying a lesser pressure to the gums to massage them without causing damage.

Another object of the present invention is to provide a toothbrush that by its shape forces a basic horizontal brushing technique and if used vertically will not damage the gums.

Another object of the present invention is to provide a toothbrush that selectively distributes brushing forces between the teeth, gum and gum line areas during horizontal stroking in the buccal corridors.

Another object of the present invention is to provide a toothbrush having bristles of selected flexibility for distributing brushing forces between the gums, teeth, and gum line areas during horizontal brushing.

The present invention provides a wide brushing surface for simultaneous contact with a user's upper gums, teeth, and lower gums, while advantageously distributing brushing forces between teeth and gums. Its width requires the use of a predominantly horizontal stroking technique and its short length results in a brush size that is practical to put in one's mouth. Use of the wide head when brushing either upper or lower teeth requires that one press the brush head into the buccal area, thus forcing simultaneous brushing of both teeth and gums. If this procedure is not followed, the brush tends to slip off the teeth because of unbalanced forces at the brush head.

Another important advantage of the widened brush shape of the present invention is that it facilitates the simultaneous and selective application of more than one dentifrice, medication, or the like to the user's teeth, gums or gumlines during normal brushing.

These and other objects and advantages of the present invention will be apparent from the following description and by reference to the accompanying drawings wherein:

FIG. 8 is a cross-sectional view of an alternative embodiment wherein the outtermost bristles are constructed from a material different from that of the innermost bristles.

FIG. 9 is an isometric view of an alternative embodiment of the present invention.

FIG. 10 is a cross-sectional view of FIG. 9 along line 10—10.

FIG. 11 is an isometric view of another alternative embodiment of the present invention.

Throughout the drawings the same reference numerals refer to the same elements.

Figure 1:
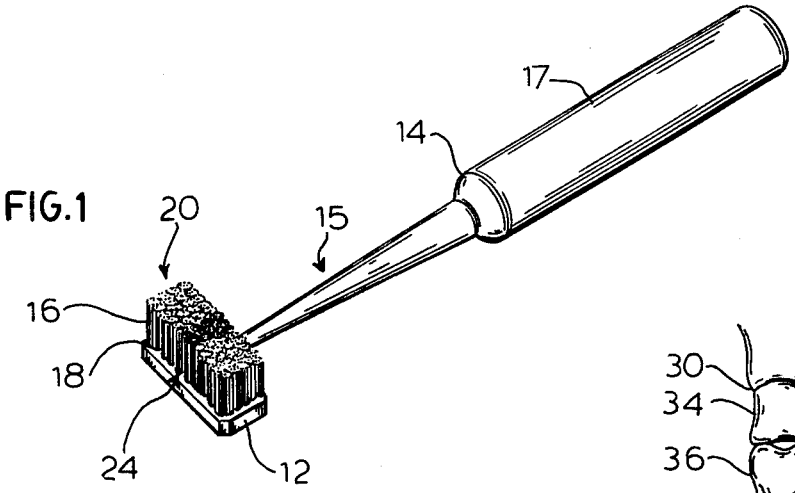
FIG. 1 is an isometric view of a toothbrush constructed in accordance with the present invention.
Figure 1B:
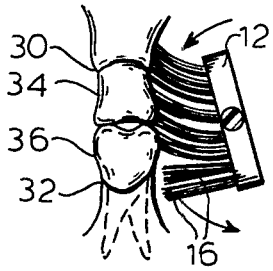
FIG. 1B is a cross-sectional side view of a toothbrush constructed in accordance with the present invention as it appears with respect to teeth and gums in a user's mouth.

Referring specifically to the drawing, FIG. 1, shows a preferred embodiment wherein the brush body 12 has an elongated handle 14 and a plurality of bristles 16 that project outwardly. The brush body 12 has a width approximately perpendicular to the longitudinal axis of the elongated handle 14. The brush body 12 width maybe 2–4 times its length, preferably 3 times its length. The bristles 16 are preferably rounded and, taken collectively, they comprise the brushing surface. The brushing surface is the portion of the brush that actually contacts the user's gums and teeth for cleaning and stimulating purposes as shown in FIG. 1B.

The brushing surface width is greater than the greatest distance between the potential user's upper 30 and lower 32 gum lines with teeth 34, 36, closed. Therefore, when the brush is placed adjacent to the closed teeth 34, 36 as shown in FIG. 1B, and moved in a horizontal path, the upper gums, teeth, and lower gums are cleaned and stimulated simultaneously. The brushing surface has a width substantially parallel to the brush body's 12 length that may be 2–4 times its length, preferably 3 times. If an attempt were made to brush either upper or lower teeth with a horizontal motion and not simultaneously contact the associated gums, forces applied through the handle acting through a moment arm having a fulcrum coinciding with the handle axis would tend to make the brush slip off the teeth. Thus the net effect of the brush geometry will make the user push the brush into the buccal area, thus assuring simultaneous brushing of teeth and gums.

The brushing forces transmitted through the brush handle 14 to teeth and gums by the brushing surface may be controlled and selectively distributed by varying the size, shape, flexibility, and arrangement of the bristles 16, as hereinafter described, to minimize damage to the gums during brushing.

Figure 2:
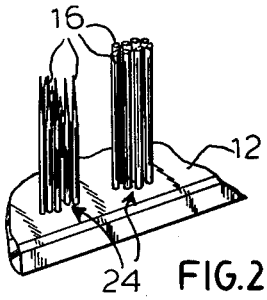
FIGS. 2 and 3 are sectional views of different bristle tuft arrangements for alternative embodiments of the present invention.
Figure 3:
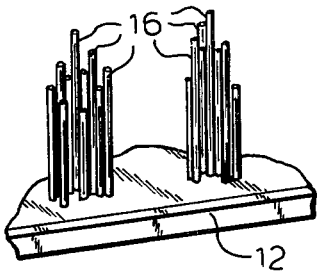
Figure 4:
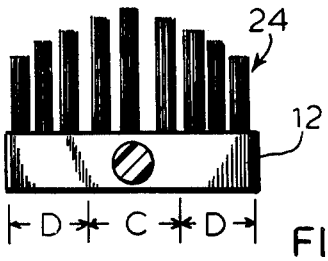
FIGS. 4–7 are cross-sectional views illustrating brushing surface designs for use in alternative embodiments of the present invention.
Figure 5:
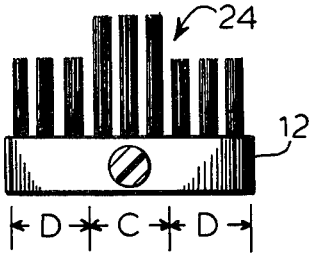

Tufts may be made more flexible by tapering individual bristles 16 as shown in FIG. 2 or varying the diameter or composition of the bristles 16, or staggering the height FIG. 3, or the like. Accordingly, bristles 16 are arranged on the brush body 12 and sized and spaced so that the portions of the brushing surface that primarily contact the gums during horizontal brushing i.e., gum areas D are more flexible or apply less brushing pressure than that portion of the brushing surface that simultaneously contacts the teeth, i.e., area C. The width of teeth cleaning portion area C is parallel to that of the brush body 12 and brushing surface and is preferably 3/16 to ¼ inch. As shown in FIG. 4 and 5, the longer tufts in Area C must be deflected more resulting in increased pressure before the tufts in Area D contact the gums.

Figure 6:
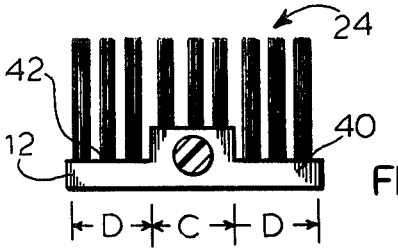
Figure 7:
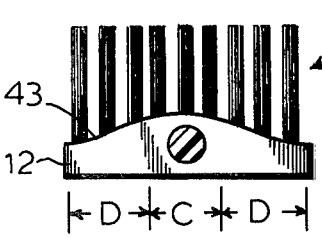

As shown in FIGS. 6 through 8, softer bristles, which reduce brushing pressure in the gum stimulating areas D, may also be accomplished by stepping 42 or curving 43 down the brush body 12 so that the gum stimulating area D bristles are longer, therefore, more flexible, than those in the teeth area C. Likewise, substituting a softer more flexible bristle material for the gum area D bristles, for example, an elastomer, as shown in FIG. 8, will have a similar result.

Other alternative means for achieving less brushing force in the gum areas D, shown in FIGS. 9 through 11, involve a brush body 50 with flexible members or segments 52 which permit the bristles in the gum stimulating area D, that is, those bristles 16 projecting from brush body segment 56 to retract when force is applied to their ends 20, as shown by phantom lines in FIG. 10. The flexing members 52 need not connect brush body segments to the brush body 50 but may alternatively connect brush body segment 56 to the elongated handle 14 as shown in FIG. 11 wherein the flexible members are designated 58.

In all embodiments, the general brush shape, i.e., wider than it is long, will prevent gum tissue and tooth damage caused when verticle brushing is employed. Straight up and down brushing cannot be done because the brush body 12 and brushing surface are too wide. However, as shown by the arrow in FIG. 1B, the brush handle may be rotated, causing the bristles to pass over the upper gumline 30 and teeth 34, 36, in a vertical path. Unlike a narrow, conventional brush used in a like manner, the wide shape will prevent the lower bristles from touching and damaging the lower gumline 32 tissue. Similarly, the upper gumline 30 tissue will not be damaged when the lower gums are vertically massaged in this fashion by rotating the brush in the opposite direction.

Another feature that may be incorporated into the present invention shown in FIG. 1 is a means for damping the overall pressure or force of the brushing surface upon the teeth and gums by providing a weakened flexing section 15 between the brush body 12 and the gripping portion of the handle 17. When a user applies excess force to the brush handle, the weakened flexing section 15 bends, thereby damping the overall pressure or force and avoiding potential damage to the gums.

While in order to comply with the statutes, the present invention has been described in specific terms, it is to be understood that the invention is not limited to the specific embodiments disclosed herein and that the invention is therefore claimed in any of its forms, modifications, or equivalents within the legitimate and valid scope of the appended claims.

What is claimed:

1. An improved toothbrush for cleaning teeth and simultaneously cleaning and stimulating gums, which comprises:

a brush body having an elongated handle;

the brush body having its width substantially perpendicular to the longitudinal axis of the elongated handle, the brush body being longest in width than its length;

a plurality of bristles having first ends embedded in the brush body and second ends projecting therefrom defining a brushing surface, the brushing surface's width being longer than its length; the brushing surface being so adapted to facilitate simultaneous selective application of more than one medication or the like;

the brushing surface having two gum-stimulating portions, one disposed along each of its lengthwise edges that primarily contact the gums during horizontal brushing and a teeth cleaning portion that primarily contact the teeth during horizontal brushing, the teeth cleaning portion never extending below the gum-stimulating portions; and the gum-stimulating portions and the teeth portion being so configured that the brushing force results in a lower pressure on the gums than is on the teeth and the brushing surface having means for providing simultaneous contact of the upper and lower gums when the respective upper and lower teeth are contacted by the brush surface, and the brushing surface and handle having further means for providing an overturning moment when the upper or lower teeth are brushed requiring the toothbrush user, to push the brush surface in the buccal corridor to prevent the brush surface from rotating away from the teeth.

2. An improved toothbrush as recited in claim 1, wherein the brushing surface, further comprises:

at least one gumline treatment portion comprising a plurality bristles of selected flexibility disposed between the teeth cleaning portion and the gum stimulating portion of the brushing surface.

3. An improved toothbrush as recited in claim 1 wherein the brush body has a width approximately three times its length, the brushing surface has a width approximately three times its length and the teeth cleaning portion is approximately 3/16 to ¼ inch.

4. An improved toothbrush as recited in claim 1 wherein the brushing surface is flat and the brush body is stepped so that the bristles comprising the gum-stimulating portions of the brushing surface are longer and more flexible than those in the teeth-cleaning portion.

5. An improved toothbrush as recited in claim 3 wherein the brush body is curved so that the bristles comprising the gum-stimulating portions of the brushing surface are longer and more flexible than those in the teeth-cleaning portion.

6. An improved toothbrush as recited in claim 3 wherein the bristles comprising the gum-stimulating portions of the brushing surface are fabricated from a more flexible material than the bristles of the teeth-cleaning portion.

7. An improved toothbrush as recited in claim 3 wherein the bristles comprising the gum-stimulating portions of the brushing surface are formed from an elastomeric compound.

8. An improved toothbrush as recited in claim 3 wherein the bristles comprising the gum-stimulating portion have a smaller diameter and are more flexible than those of the teeth cleaning portion.

9. An improved toothbrush as recited in claim 3 wherein the bristles comprising the gum-stimulating portions of the brushing surface are tapered and more flexible than those in the teeth-cleaning portion.

10. An improved toothbrush as recited in any of claims 9 wherein at last some of the bristles are arranged in tufts.

11. An improved toothbrush as recited in claim 10 wherein the tufts in the gum-stimulating portions of the brushing surface have bristles of variable length, more flexible than those in the teeth-cleaning portion.

12. An improved toothbrush as recited in claim 10 wherein the tufts of bristles comprising the gum-stimulating portion are more flexible than those of the teeth-cleaning portion.

13. An improved toothbrush as recited in claim 10 wherein the tufts of bristles comprising the gum-stimulating portion are less dense than those in the tooth portion and when taken together are more flexible than those in the teeth-cleaning portion.

14. An improved toothbrush as recited in claim 3 wherein the bristles comprising the gum-stimulating portions are disposed on independent brush body segments connected and to the brush body by flexible members that permit deflection of the independent segments resulting in less pressure being applied by the gum-stimulating portions during brushing.

15. An improved toothbrush as recited in claim 3 wherein the bristles comprising the gum-stimulating portions are disposed on independent brush body segments adjacent to the brush body and connected to the elongated handle by flexible members such that less brushing pressure is applied by the gum-stimulating portions during brushing.

16. An improved toothbrush for cleaning teeth and cleaning and stimulating gums, which comprises:

a brush body having an elongated handle;

the brush body having its width substantially perpendicular to the axis of the elongated handle the brush body width being 2–4 times its length;

a plurality of bristles having first ends embedded in the brush body and second ends projecting therefrom defining a brushing surface;

the brush body width, the brushing surface's width being 2–4 times its length;

the brushing surface having two gum stimulating portions one disposed along each of its lengthwise edges that primarily contact the gums during horizontal brushing and a teeth cleaning portion disposed between the gum stimulating portions that primarily contacts the teeth during horizontal brushing;

the brushing surface being stepped so that shorter bristles comprise the gum-stimulating portions and longer bristles comprise the teeth cleaning portion so that the shorter bristles contact the gums only after significant deflection of the longer bristles causing greater brushing pressure to be applied to teeth and the brushing surface having means for providing simultaneous contact of the upper and lower gums when the respective upper and lower teeth are contacted by the brush surface, and the brushing surface and handle having further means for providing an overturning moment when the upper or lower teeth are brushed requiring the toothbrush user to push the brush surface in the buccal corridor to prevent the brush surface from rotating away from the teeth.

17. A improved toothbrush as recited in claim 16 wherein the brushing surface is convex.

18. An improved toothbrush as recited in any one of claims 1 through 9 or 11 through 17 wherein a flexible weakened section is provided between the brush body and the elongated handle to dampen the brushing force transmitted to a user's teeth and gums.

* * * * *

UNITED STATES PATENT AND TRADEMARK OFFICE

CERTIFICATE OF CORRECTION

PATENT NO. : 4,472,853

DATED : September 25, 1984

INVENTOR(S) : Samuel Rauch

It is certified that error appears in the above-identified patent and that said Letters Patent is hereby corrected as shown below:

Column 5, line 24, "Claims 9" should be --claims 1 - 9--.

Signed and Sealed this

*Second* Day of *April 1985*

[SEAL]

*Attest:*

DONALD J. QUIGG

*Attesting Officer*

*Acting Commissioner of Patents and Trademarks*